US009335718B2

(12) United States Patent
Suzuki

(10) Patent No.: US 9,335,718 B2
(45) Date of Patent: May 10, 2016

(54) IMAGE FORMING APPARATUS

(71) Applicant: BROTHER KOGYO KABUSHIKI KAISHA, Nagoya-shi, Aichi-ken (JP)

(72) Inventor: Yasuhiro Suzuki, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/664,412

(22) Filed: Mar. 20, 2015

(65) Prior Publication Data

US 2015/0277279 A1 Oct. 1, 2015

(30) Foreign Application Priority Data

Mar. 28, 2014 (JP) ..... 2014-070359

(51) Int. Cl.

| | |
|---|---|
| ***G03G 15/08*** | (2006.01) |
| ***G03G 21/16*** | (2006.01) |
| ***G03G 15/23*** | (2006.01) |
| *G03G 15/01* | (2006.01) |

(52) U.S. Cl.

CPC ..... *G03G 21/1647* (2013.01); *G03G 15/234* (2013.01); *G03G 15/0194* (2013.01); *G03G 2221/1657* (2013.01)

(58) Field of Classification Search

CPC ..... G03G 15/234; G03G 21/1825
See application file for complete search history.

(56) References Cited

U.S. PATENT DOCUMENTS

| | | | | |
|---|---|---|---|---|
| 5,081,508 | A * | 1/1992 | Kotani et al. | 399/21 |
| 6,389,243 | B2 * | 5/2002 | Makino | 399/53 |
| 2002/0098013 | A1 * | 7/2002 | Kamimura | 399/167 |
| 2003/0170048 | A1 * | 9/2003 | Ahn | 399/167 |
| 2004/0052547 | A1 * | 3/2004 | Matsuura et al. | 399/119 |
| 2008/0118274 | A1 * | 5/2008 | Ahn et al. | 399/167 |
| 2009/0035041 | A1 * | 2/2009 | Yang | 399/401 |
| 2009/0060568 | A1 * | 3/2009 | Ishikawa et al. | 399/111 |
| 2009/0180808 | A1 * | 7/2009 | Hyun-ho | 399/222 |
| 2013/0168921 | A1 * | 7/2013 | Suzuki et al. | 271/225 |
| 2014/0016957 | A1 * | 1/2014 | Suzuki et al. | 399/67 |
| 2014/0016979 | A1 * | 1/2014 | Suzuki et al. | 399/388 |

FOREIGN PATENT DOCUMENTS

| | | | |
|---|---|---|---|
| JP | 3620993 | B2 | 2/2005 |
| JP | 2014021194 | A | 2/2014 |

* cited by examiner

*Primary Examiner* — G. M. Hyder
(74) *Attorney, Agent, or Firm* — Merchant & Gould P.C.

(57) ABSTRACT

An image forming apparatus includes: a rotatable first developer carrier; a tray on which a recording sheet is to be discharged; a switchback roller configured to rotate in a first rotating direction to convey the recording sheet in a direction coming close to the tray, and a control device configured to switch a rotating direction of the switchback roller from the first rotating direction to a second rotating direction opposite to the first rotating direction after rotation of the first developer carrier is stopped.

17 Claims, 10 Drawing Sheets

IMAGE FORMING APPARATUS

CROSS REFERENCE TO RELATED APPLICATION

This application is based upon and claims the benefit of priority of Japanese Patent Application No. 2014-070359 filed on Mar. 28, 2014, the contents of which are incorporated herein by reference in its entirety.

BACKGROUND

The present disclosure relates to an image forming apparatus configured to form images on both surfaces of a recording sheet.

In the related art, an image forming apparatus configured to form images on both surfaces of a recording sheet such as a sheet has been known. For example, an related image forming apparatus is configured to convey a sheet of which one surface has been formed with an image in an image forming unit from the image forming unit towards an outside of a housing by conveyance rollers being rotating in a forward direction and to rotate the conveyance rollers in a reverse direction before a rear end portion of the sheet exits the conveyance rollers, thereby guiding the sheet to a re-conveyance path. The image forming apparatus is configured to again feed the sheet guided to the re-conveyance path to the image forming unit, to form an image on the other surface of the sheet and then to discharge the sheet from the image forming unit to the outside of the housing by the conveyance rollers being rotating in the forward direction.

In the image forming apparatus configured to form the images on both surfaces of the sheet and then to feed a next sheet, there is no sheet in the image forming unit while the sheet is again conveyed towards the image forming unit. However, according to the related art, a developing device is driven even while the sheet is again conveyed towards the image forming unit. Therefore, performances of a member configuring the developing device, developer received in the developing device, and the like may be degraded beyond necessity.

SUMMARY

It is therefore an object of the present disclosure to provide an image forming apparatus capable of suppressing unnecessary driving of a developing device.

An aspect of the present disclosure provides the following arrangements:

An image forming apparatus comprising:

an image forming unit including a first photosensitive member configured to form thereon a developer image and a first developing device configured to receive developer and to supply the developer to the first photosensitive member, the image forming unit being configured to transfer the developer image onto a recording sheet and to form an image on the recording sheet;

a housing having a discharge opening configured to discharge the recording sheet having the image formed thereon, the image forming unit being disposed in the housing;

a switchback roller configured to convey the recording sheet from the image forming unit towards the discharge opening by forwardly rotating the switchback roller and to again convey the recording sheet carried out of the image forming unit towards the image forming unit by reversely rotating the switchback roller;

a first driving source including an output shaft configured to transmit a driving force, the first driving source being configured to switch a rotating direction of the output shaft and to rotate the switchback roller in one of a forward direction and a reverse direction by switching the rotating direction of the output shaft, and a control device configured to control driving of the first developing device and switchback roller, wherein the control device stops driving of the first developing device and then rotates the switchback roller in the reverse direction when re-conveying the recording sheet towards the image forming unit.

An image forming apparatus comprising:

a rotatable first developer carrier;

a tray on which a recording sheet is to be discharged;

a switchback roller configured to rotate in a first rotating direction to convey the recording sheet in a direction coming close to the tray, and a control device configured to switch a rotating direction of the switchback roller from the first rotating direction to a second rotating direction opposite to the first rotating direction after rotation of the first developer carrier is stopped.

An image forming apparatus comprising:

a rotatable developer carrier;

a tray on which a recording sheet is to be discharged;

a switchback roller configured to rotate in a first direction and a second direction opposite to the first direction;

a motor configured to drive the switchback roller; and a control device, wherein the control device is configured to control the motor to reverse a rotation direction of the motor after rotation of the developer carrier is stopped.

BRIEF DESCRIPTION OF DRAWINGS

FIG. 2 illustrates a connection/separation mechanism, in which FIG. 2A illustrates a first contact state, FIG. 2B illustrates a second contact state, and FIG. 2C illustrates a separation state.

DESCRIPTION OF ILLUSTRATIVE EMBODIMENTS

First Illustrative Embodiment

Figure 1:
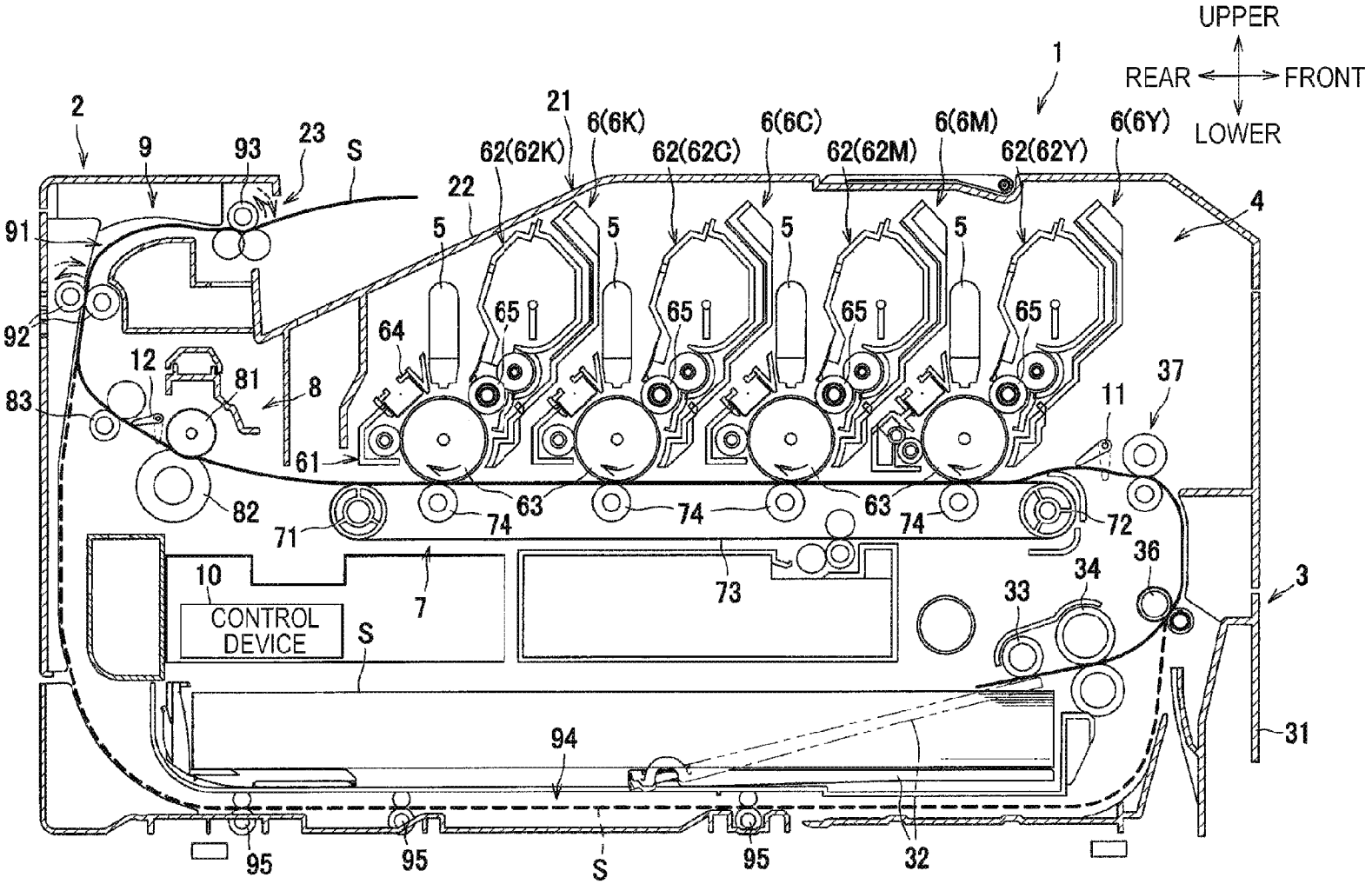
FIG. 1 illustrates a schematic configuration of an image forming apparatus.

Hereinafter, a first illustrative embodiment will be described in detail with reference to the drawings. Meanwhile, in below descriptions, directions are described on the basis of a user who uses an image forming apparatus. Specifically, a right side of FIG. 1, which is a front side as seen from a user, is referred to as a 'front', a left side of FIG. 1, which is an inner side as seen from the user, is referred to as a 'rear', a front side of the drawing sheet of FIG. 1 is referred to as 'left' and an inner side of the drawing sheet is referred to as 'right'. An upper-lower direction of FIG. 1 is referred to as 'upper and lower'.

<Schematic Configuration of Image Forming Apparatus>

As shown in FIG. 1, a color printer 1, which is an example of the image forming apparatus, is configured to form images on both surfaces of a sheet S, which is an example of the recording sheet, and mainly has a housing 2, and a feeder unit 3, an image forming unit 4 and a conveyance unit 9, which are arranged in the housing 2.

The housing 2 mainly has an upper cover 21 configured to rotate in the upper-lower direction about a rotary shaft (not shown) provided at a rear side thereof and to be thus opened and closed, a sheet discharge tray 22 on which the sheet S having the image formed thereon is placed, and a discharge opening 23 for discharging the sheet S to the sheet discharge tray 22.

The feeder unit 3 is provided at a lower part in the housing 2, and mainly has a sheet feeding tray 31 configured to receive sheets S, a sheet pressing plate 32, a feeder roller 33, separation rollers 34, conveyance rollers 36, and register rollers 37. The feeder unit 3 is configured to incline the sheets S in the sheet feeding tray 31 towards the feeder roller 33 by the sheet pressing plate 32 and to deliver the same from the sheet feeding tray 31 towards the image forming unit 4 by the feeder roller 33. Then, the feeder unit 3 is configured to separate the sheets S delivered from the sheet feeding tray 31 one by one by the separation rollers 34 and to feed the same to the image forming unit 4 by the conveyance rollers 36 and the register rollers 37.

The image forming unit 4 is configured to transfer a toner image, which is an example of the developer image, onto the sheet S and to form an image thereon, and mainly has four LED units 5, four process units 6, a transfer unit 7, and a fixing unit 8.

The LED unit 5 is arranged above a photosensitive drum 63 to face the same, and has a plurality of LEDs (Light Emitting Diodes) (not shown) at a lower end thereof, which are arranged in a left-right direction. The LEDs are blinked, based on image data, so that the LED unit 5 exposes a surface of the photosensitive drum 63. The LED unit 5 is held at the upper cover 21 by a holding member (not shown). When the upper cover 21 is opened, the LED unit 5 is moved together with the upper cover 21 and is thus separated from the photosensitive drum 63.

The process units 6 are arranged side by side in a front-rear direction between the sheet discharge tray 22 and the sheet feeding tray 31, and can be mounted or demounted to or from the housing 2 with the upper cover 21 being opened. Each process unit 6 has a drum cartridge 61 and a developing cartridge 62 configured to be detachably mounted to the drum cartridge 61. Each drum cartridge 61 has the photosensitive drum 63, a charger 64, and the like. Each developing cartridge 62 has a developing roller 65, a supply roller, a layer thickness regulation blade, a toner accommodation part configured to receive toner that is an example of the developer, and the like whose reference numerals are omitted.

The process units 6 are configured so that the process units 6Y, 6M, 6C, 6K, in which toners of respective colors of yellow, magenta, cyan and black are received, are arranged side by side from the front side in corresponding order. Hereinafter, in the specification and drawings, when specifying the developing cartridges 62, the photosensitive drums 63 and the like corresponding to the toner colors, the reference numerals Y, M, C and K are attached in correspondence to yellow, magenta, cyan and black, respectively.

The transfer unit 7 is provided between the sheet feeding tray 31 and the process units 6, and mainly has a driving roller 71, a driven roller 72, an endless conveyance belt 73, and four transfer rollers 74. The conveyance belt 73 extends with being tensioned between the driving roller 71 and the driven roller 72 and has an outer surface arranged to face the four photosensitive drums 63. At an inner side of the conveyance belt 73, the transfer rollers 74 are arranged to sandwich the conveyance belt 73 between the transfer rollers 74 and the corresponding photosensitive drums 63.

The fixing unit 8 is provided at the rear of the process units 6 and transfer unit 7, and mainly has a heating roller 81 and a pressing roller 82 arranged to face the heating roller 81 and configured to press the heating roller 81.

In the image forming unit 4, the surface of the photosensitive drum 63 being rotated is uniformly charged by the charger 64 and is then exposed by the LED unit 5, so that an electrostatic latent image based on the image data is formed on the photosensitive drum 63. The toner in the toner accommodation part is supplied from the supply roller to the developing roller 65, is regulated to a predetermined thickness between the developing roller 65 and the layer thickness regulation blade by rotation of the developing roller 65, and is then carried on the developing roller 65.

Then, the toner carried on the developing roller 65 is supplied to the photosensitive drum 63, so that the electrostatic latent image becomes visible and a toner image is thus formed on the photosensitive drum 63. After that, the sheet S fed from the feeder unit 3 is conveyed between the photosensitive drums 63 and the conveyance belt 73, so that the toner image on the photosensitive drum 63 is transferred to the sheet S. The sheet S having the toner images transferred thereto is conveyed between the heating roller 81 and the pressing roller 82, so that the toner images are heat-fixed on the sheet S and an image is thus formed on the sheet S. The sheet S having the toner images heat-fixed thereon is carried out of the fixing device 8 to the conveyance path 71 by carrying-out rollers 83.

The conveyance unit 9 is configured to convey the sheet S, which is carried out of the image forming unit 4, towards an outside of the housing 2 or again towards the image forming unit 4, and mainly has the conveyance path 91, conveyance rollers 92 and discharge rollers 93, which are examples of the switchback roller, a re-conveyance path 94 and a plurality of re-conveyance rollers 95 provided on the re-conveyance path 94.

The conveyance path 91 extends upwardly from the vicinity of the carrying-out rollers 83 and is then curved forwards to face towards the discharge opening 23. The re-conveyance path 94 extends downwardly from the vicinity of the rear of the carrying-out rollers 83, is curved forwards, extends forwards along the lower of the sheet feeding tray 31, is curved upwardly and then extends towards the conveyance rollers 36.

The conveyance rollers 92 and the discharge rollers 93 are rollers configured to be rotatable in forward and reverse directions. Specifically, upon forward rotation indicated by the solid arrow, the conveyance rollers 92 and the discharge rollers 93 are configured to convey the sheet S from the image forming unit 4 towards the discharge opening 23, and upon reverse rotation indicated by the dotted arrow, conveyance rollers 92 and the discharge rollers 93 are configured to again convey the sheet S carried out of the image forming unit 4 towards the image forming unit 4.

When forming an image on only one surface of the sheet S, the conveyance unit 9 conveys the sheet S carried out of the image forming unit 4 by the carrying-out rollers 83 towards the discharge opening 23 by the conveyance rollers 92 and the discharge rollers 93 being rotating in the forward direction and discharges the sheet S onto the sheet discharge tray 22 through the discharge opening 23.

On the other hand, when forming images on both surfaces of the sheet S, the conveyance unit 9 conveys the sheet S carried out of the image forming unit 4 by the carrying-out rollers 83 towards the discharge opening 23 by the conveyance rollers 92 and the discharge rollers 93 being rotating in the forward direction, once stops the conveyance rollers 92 and the discharge rollers 93 at timing before a rear end of the sheet S exits between the conveyance rollers 92, and then rotates the conveyance rollers 92 and the discharge rollers 93 in the reverse direction. Thereby, the sheet S having the image formed on the one surface is guided to the re-conveyance path 94. Then, the sheet S (refer to the broken line) guided to the re-conveyance path 94 is again fed to the image forming unit 4 by the re-conveyance rollers 95, the conveyance rollers 36 and the register rollers 37.

The sheet S again fed to the image forming unit 4 is formed on the other surface thereof with an image in the image forming unit 4 and is then carried out of the image forming unit 4 by the carrying-out rollers 83. Then, the conveyance unit 9 conveys the sheet S carried out of the image forming unit 4 by the carrying-out rollers 83 towards the discharge opening 23 by the conveyance rollers 92 and the discharge rollers 93 being rotating in the forward direction and discharges the same onto the sheet discharge tray 22 through the discharge opening 23.

The color printer 1 is configured to execute a monochrome mode in which a monochrome image is formed on the sheet S using only the process unit 6K and a color mode in which a color image is formed on the sheet S using all the process units 6Y, 6M, 6C, 6K.

When executing the color mode, a first contact state where all the developing rollers 65Y, 65M, 65C, 65K respectively contact the corresponding photosensitive drums 63Y, 63M, 63C, 63K is made, as shown in FIG. 2A. In the meantime, when executing the monochrome mode, a second contact state where the developing roller 65K contacts the corresponding photosensitive drum 63K and the developing rollers 65Y, 65M, 65C are respectively separated from the corresponding photosensitive drums 63Y, 63M, 63C is made, as shown in FIG. 2B.

The color printer 1 becomes at a separation state where all the developing rollers 65Y, 65M, 65C, 65K are separated from the corresponding photosensitive drums 63Y, 63M, 63C, 63K when the sheet S is again conveyed towards the image forming unit 4 or when the image formation is over, as shown in FIG. 2C. Meanwhile, in this illustrative embodiment, the separation state shown in FIG. 2C corresponds to both the 'first separation state' and the 'second separation state'.

Configuration of Driving Mechanism of Color Printer

Subsequently, a configuration of a driving mechanism of the color printer 1 is described. Here, in this illustrative embodiment, the photosensitive drum 63K corresponds to the 'first photosensitive member', the developing cartridge 62K corresponds to the 'first developing device', and the developing roller 65K provided for the developing cartridge 62K corresponds to the 'first developing roller'. The photosensitive drums 63Y, 63M, 63C correspond to the 'second photosensitive member', the developing cartridges 62Y, 62M, 62C correspond to the 'second developing device', and the developing rollers 65Y, 65M, 65C provided for the developing cartridges 62Y, 62M, 62C correspond to the 'second developing roller'.

Figure 3:
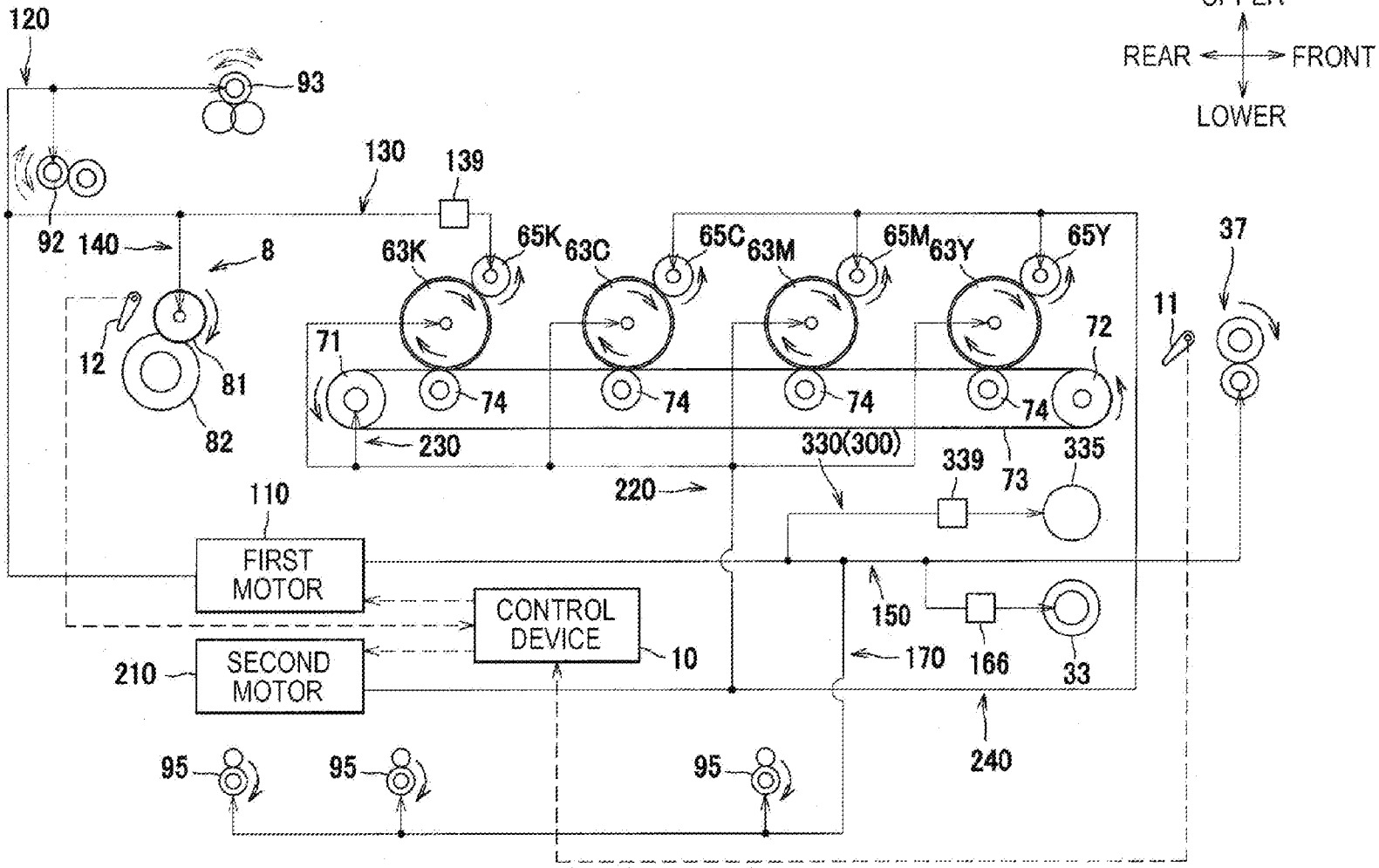
FIG. 3 illustrates a driving mechanism of the image forming apparatus.

As shown in FIG. 3, the color printer 1 has a first motor 110 that is an example of the first driving source, a second motor 210 that is an example of the second driving source, a switchback driving mechanism 120, a first developing driving mechanism 130, a fixing driving mechanism 140, a feeder driving mechanism 150, a re-conveyance driving mechanism 170, a photosensitive member driving mechanism 220, a belt driving mechanism 230, a second developing driving mechanism 240 and a connection/separation mechanism 300.

The first motor 110 is a motor for applying a driving force to the developing roller 65K (developing cartridge 62K) configured to supply the black toner to the photosensitive drum 63K, the conveyance rollers 92, the discharge rollers 93, and the like. The first motor 110 is configured to switch a rotating direction of an output shaft (not shown) of the driving force, and to switch the rotating direction of the output shaft, thereby rotating the conveyance rollers 92 and the discharge rollers 93 in the forward or reverse direction. The first motor 110 is configured to apply a driving force to the carrying-out rollers 83.

The second motor 210 is a motor for applying the driving force to the photosensitive drums 63Y, 63M, 63C, 63K, the developing rollers 65Y, 65M, 65C (developing cartridges 62Y, 62M, 62C) configured to supply the yellow, magenta and cyan toners to the photosensitive drums 63Y, 63M, 63C, the conveyance belt 73, and the like. When the second motor 210 is driven, the output shaft (not shown) of the driving force is always rotated in the same direction.

The switchback driving mechanism 120 is a mechanism for transmitting the driving force of the first motor 110 to the conveyance rollers 92 and the discharge rollers 93. The switchback driving mechanism 120 consists of a plurality of gears (not shown). The switchback driving mechanism 120 is configured to rotate the conveyance rollers 92 and the discharge rollers 93 in the forward direction when the output shaft of the first motor 110 is rotated in one direction (hereinafter, referred to as forward rotation) and to rotate the conveyance rollers 92 and the discharge rollers 93 in the reverse direction when the output shaft of the first motor 110 is rotated in an opposite direction (hereinafter, referred to as reverse rotation). In the meantime, since the well-known configurations can be adopted as regards the specific configurations and arrangements of the gears, the illustrations and descriptions of the specific configurations of the respective driving mechanisms are here omitted.

The first developing driving mechanism 130 is a mechanism for transmitting the driving force of the first motor 110 to the developing roller 65K (developing cartridge 62K). The first developing driving mechanism 130 mainly consists of a plurality of gears and is configured to rotate the developing roller 65K in a shown counterclockwise direction, irrespective of the rotating direction of the output shaft of the first motor 110. The first developing driving mechanism 130 has a developing clutch 139, which is an example of the transmission switching device. The developing clutch 139 is an electromagnetic clutch having a well-known configuration, and is configured to switch a connection state where the driving force from the first motor 110 can be transmitted to the developing roller 65K and a cutoff state where the driving force from the first motor 110 cannot be transmitted to the developing roller 65K.

The fixing driving mechanism 140 is a mechanism for transmitting the driving force of the first motor 110 to the heating roller 81. The fixing driving mechanism 140 consists of a plurality of gears (not shown), and is configured to rotate the heating roller 81 in the shown clockwise direction when the output shaft of the first motor 110 is rotated in the forward direction and not to transmit the driving force to the heating roller 81 when the output shaft of the first motor 110 is rotated in the reverse direction.

The feeder driving mechanism 150 is a mechanism for transmitting the driving force of the first motor 110 to the feeder roller 33, the register rollers 37 and the like (the feeder unit 3). The feeder driving mechanism 150 mainly consists of a plurality of gears, and is configured to rotate the feeder roller 33 and the like in the same direction, irrespective of the rotating direction of the output shaft of the first motor 110. The feeder driving mechanism 150 has a feeder clutch 166. The feeder clutch 166 is an electromagnetic clutch having a well-known configuration, and is configured to switch a connection state where the driving force from the first motor 110 can be transmitted to the feeder roller 33 and a cutoff state where the driving force from the first motor 110 cannot be transmitted to the feeder roller 33.

The re-conveyance driving mechanism 170 is a mechanism for transmitting the driving force of the first motor 110 to the re-conveyance rollers 95. The re-conveyance driving mechanism 170 mainly consists of a plurality of gears and is configured to rotate the re-conveyance rollers 95 in the shown clockwise direction, irrespective of the rotating direction of the output shaft of the first motor 110.

The photosensitive member driving mechanism 220 is a mechanism for transmitting the driving force of the second motor 210 to the photosensitive drums 63Y, 63M, 63C, 63K. The photosensitive member driving mechanism 220 consists of a plurality of gears (not shown), and is configured to rotate the photosensitive drum 63Y, 63M, 63C, 63K in the shown clockwise direction when the second motor 210 is driven, and to stop the driving of the photosensitive drums 63Y, 63M, 63C, 63K when the driving of the second motor 210 is stopped.

The belt driving mechanism 230 is a mechanism for transmitting the driving force of the second motor 210 to the driving roller 71 (transfer unit 7). The belt driving mechanism 230 consists of a plurality of gears (not shown), and is configured to rotate the driving roller 71 in the shown counterclockwise direction when the second motor 210 is driven, and to stop the driving of the driving roller 71 when the driving of the second motor 210 is stopped.

The second developing driving mechanism 240 is a mechanism for transmitting the driving force of the second motor 210 to the developing rollers 65Y, 65M, 65C (developing cartridges 62Y, 62M, 62C). The second developing driving mechanism 240 mainly consists of a plurality of gears (not shown), and is configured to transmit the driving force of the second motor 210 to the developing roller 65Y, 65M, 65C at the first contact state shown in FIG. 2A and not to transmit the driving force of the second motor 210 to the developing roller 65Y, 65M, 65C at the second contact state shown in FIG. 2B or at the separation state shown in FIG. 2C.

Figure 2:
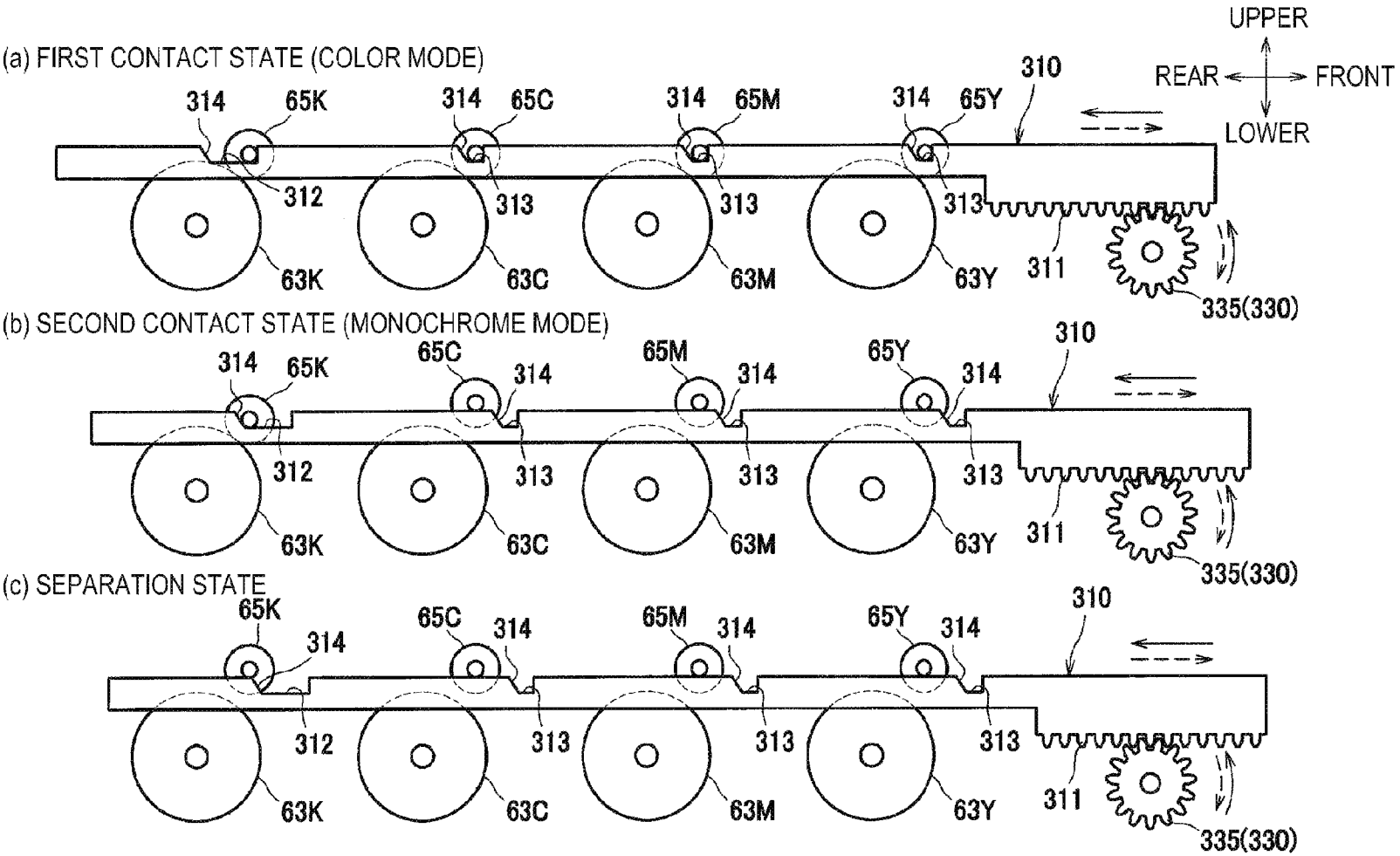

As shown in FIG. 2, the connection/separation mechanism 300 is configured to switch the first contact state shown in FIG. 2A, the second contact state shown in FIG. 2B and the separation state shown in FIG. 2C, and mainly has a connection/separation cam 310 and a connection/separation driving mechanism 330.

The connection/separation cam 310 is a substantially plate-shaped member provided at a side of the process unit 6 and long in the front-rear direction, and is supported to the housing 2 so that it can move in the front-rear direction. An upper surface of the connection/separation cam 310 is formed with one recess portion 312 engageable with the rotary shaft (a reference numeral thereof is omitted) of the developing roller 65K, three recess portions 313 engageable with the rotary shafts of the developing roller 65Y, 65M, 65C, and inclined surfaces 314 inclined at an upward gradient from front towards rear in a direction facing from rear sides of bottoms of the recess portions 312, 313 towards the upper surface of the connection/separation cam 310. The recess portion 312 is formed to be longer than the recess portions 313 in the front-rear direction.

The connection/separation driving mechanism 330 is a mechanism for transmitting the driving force of the first motor 110 to the connection/separation cam 310. As shown in FIG. 3, the connection/separation driving mechanism 330 has a plurality of gears including a connection/separation cam driving gear 335 and a connection/separation clutch 339. The connection/separation clutch 339 is an electromagnetic clutch having a well-known configuration, and is configured to switch a connection state where the driving force from the first motor 110 can be transmitted to the connection/separation cam driving gear 335 and a cutoff state where the driving force from the first motor 110 cannot be transmitted to the connection/separation cam driving gear 335. At the connection state of the connection/separation clutch 339, the connection/separation driving mechanism 330 is configured to rotate the connection/separation cam driving gear 335 in the counterclockwise direction of FIG. 2 when the output shaft of the first motor 110 is rotated in the forward direction and to rotate the connection/separation cam driving gear 335 in the clockwise direction of FIG. 2 when the output shaft of the first motor 110 is rotated in the reverse direction.

As shown in FIG. 2A, when the first motor 110 is rotated in the reverse direction and the connection/separation cam driving gear 335 is thus rotated in the shown clockwise direction from the first contact state where all the developing rollers 65 respectively contact the photosensitive drums 63, the connection/separation cam 310 is moved forwards. Resultantly, the rotary shafts of the developing rollers 65Y, 65M, 65C of the rotary shafts of the four developing rollers 65 engaged with the recess portions 312, 313 are first moved upwardly along the inclined surfaces 314, so that the developing rollers 65Y, 65M, 65C are separated from the corresponding photosensitive drum 63Y, 63M, 63C, as shown in FIG. 2B. When the connection/separation cam 310 is stopped at this stage, the second contact state where only the developing roller 65K contacts photosensitive drum 63K is made.

When the connection/separation cam driving gear 335 is rotated in the clockwise direction from the state shown in FIG. 2B, the connection/separation cam 310 is moved more forwards. Resultantly, as shown in FIG. 2C, the rotary shaft of the developing roller 65K is moved upwardly along the inclined surface 314, so that the developing roller 65K is separated from the photosensitive drum 63K. Thereby, the separation state where all the developing rollers 65 are separated from the photosensitive drums 63 is made.

When the first motor 110 is rotated in the forward direction and the connection/separation cam driving gear 335 is thus rotated in the counterclockwise direction from the separation state of FIG. 2C, the connection/separation cam 310 is moved rearwards. Resultantly, the rotary shaft of the developing roller 65K of the rotary shafts of the four developing rollers 65 supported on the upper surface of the connection/separation cam 310 is first engaged with the recess portion 312 and is moved downwardly, so that the developing roller 65K contacts the photosensitive drum 63K, as shown in FIG. 2B. When the connection/separation cam 310 is stopped at this stage, the second contact state is made. When the connection/separation cam driving gear 335 is rotated in the counterclockwise direction from the state of FIG. 2B, the connection/separation cam 310 is moved more rearwards. Resultantly, as shown in FIG. 2A, the rotary shafts of the developing roller 65Y, 65M, 65C are engaged with the recess portions 313 and are moved downwards, so that the developing roller 65Y, 65M, 65C contact the corresponding photosensitive drum 63Y, 63M, 63C. Thereby, the first contact state is made.

<Configuration for Controlling Driving Mechanism>

Subsequently, a configuration for controlling the driving functions of the color printer 1 is described.

As shown in FIG. 1, the color printer 1 has a control device 10, a first sheet sensor 11 and a second sheet sensor 12.

The first sheet sensor 11 and the second sheet sensor 12 are sensors for detecting the sheet S being conveyed in the housing 2, and have an actuator configured to swing as the sheet S abuts thereon and an optical sensor configured to detect the swinging of the actuator, respectively, for example. The first sheet sensor 11 is provided between the register rollers 37 and the conveyance belt 73 on the conveyance path of the sheet S. The second sheet sensor 12 is provided between the fixing unit 8 and the carrying-out rollers 83 on the conveyance path of the sheet S. In below descriptions, a state where the first sheet sensor 11 and the second sheet sensor 12 detect the sheet S is referred to as 'ON' and a state where the first sheet sensor 11 and the second sheet sensor 12 do not detect the sheet S is referred to as 'OFF.'

The control device 10 is a device configured to control the first motor 110, the second motor 210, the developing clutch 139 and the like to thus control the driving of the developing rollers 65 (developing cartridges 62), the conveyance rollers 92, the discharge rollers 93 and the like, and is provided at an appropriate position in the housing 2. The control device 10 has a CPU (Central Processing Unit), a RAM (Random Access Memory), a ROM (Read Only Memory), an I/O interface and the like (which are not shown) and is configured to execute the control by performing respective calculation processing on the basis of detection results of the sheet sensors 11, 12 and the like, a preset program and the like.

When forming images on both surfaces of the sheet S, the control device 10 controls the image forming unit 4 and the like to convey the sheet S, to form an image on one surface of the sheet S and to carry the sheet S having the image formed thereon out of the image forming unit 4. Then, the control device 10 conveys the sheet S carried out of the image forming unit 4 towards the discharge opening 23 by the conveyance rollers 92 and discharge rollers 93 being rotated in the forward direction, once stop the conveyance rollers 92 and discharge rollers 93 at timing before a rear end of the sheet S exits between the conveyance rollers 92, and then rotates the conveyance rollers 92 and discharge rollers 93 in the reverse direction, thereby guiding the sheet S to the re-conveyance path 94 and re-conveying the same towards the image forming unit 4.

When re-conveying the sheet S towards the image forming unit 4, the control device 10 stops the driving of the photosensitive drums 63 and developing rollers 65 (developing cartridges 62) and then rotates the conveyance rollers 92 and discharge rollers 93 in the reverse direction.

Specifically, when first time T1 elapses after the first sheet sensor 11 becomes OFF as the rear end of the sheet S passes through the first sheet sensor 11, the control device 10 stops the photosensitive drums 63 and developing rollers 65. Specifically, the control device 10 is configured to switch the developing clutch 139 from the connection state to the cutoff state to thus stop the driving of the developing roller 65K (developing cartridge 62K) and to stop the driving of the second motor 210 to thus stop the driving of the developing rollers 65Y, 65M, 65C (developing cartridges 62Y, 62M, 62C) and photosensitive drums 63Y, 63M, 63C, 63K. Here, the first time T1 is preset as a time period after the rear end of the sheet S passes through the first sheet sensor 11 until the rear end of the sheet S reaches between the transfer unit 7 and the fixing unit 8 (until the rear end of the sheet S enters the fixing unit 8).

After the driving of the photosensitive drums 63 and developing rollers 65 is stopped, the control device 10 once stops the first motor 110 and then rotates the same in the reverse direction when a second time T2 elapses after the second sheet sensor 12 becomes OFF as the rear end of the sheet S passes through the second sheet sensor 12. Thereby, after the driving of the photosensitive drums 63 and developing rollers 65 is stopped, the conveyance rollers 92 and discharge rollers 93 are rotated in the reverse direction. Here, the second time T2 is preset as a time period after the rear end of the sheet S passes through the second sheet sensor 12 until the rear end of the sheet S exits between the conveyance rollers 92.

While the conveyance rollers 92 and discharge rollers 93 are rotated in the reverse direction, the control device 10 controls the connection/separation mechanism 300 to switch the state from the first contact state shown in FIG. 2A to the separation state shown in FIG. 2C for the color mode, and to switch the state from the second contact state shown in FIG. 2B to the separation state shown in FIG. 2C for the monochrome mode. Specifically, the control device 10 is configured to switch the connection/separation clutch 339 from the cutoff state to the connection state to transmit the driving force of the first motor 110 being rotated in the reverse direction to the connection/separation cam 310 and to thus move forwards the connection/separation cam 310, thereby switching the state from the first or second contact state to the separation state. When a third time T3 elapses after the first motor 110 starts to rotate in the reverse direction, the control device 10 once stops the first motor 110 and then rotates the same in the forward direction. Here, the third time T3 is a time period at least after the first motor 110 starts to rotate in the reverse direction until the rear end of the sheet S exits between the conveyance rollers 92, and is preset as a time period enough to drive the connection/separation cam 310, thereby switching the state from the first contact state or second contact state to the separation state.

The control device 10 is configured to start (resume) the driving of the second motor 210 at timing different from the timing of controlling the first motor 110 to switch the conveyance rollers 92 and discharge rollers 93 from the reverse rotation to the forward rotation, and to switch the developing clutch 139 from the cutoff state to the connection state. Specifically, when a fourth time T4 elapses after switching the rotation of the first motor 110 from the reverse rotation to the forward rotation (after resuming the forward rotation), the control device 10 resumes the driving of the second motor 210 and switches the developing clutch 139 to the connection state, thereby resuming the driving of the photosensitive drums 63 and developing rollers 65. Here, the fourth time T4 is preset as a time period after the forward rotation of the first motor 110 is resumed until a front end of the sheet S reaches the register rollers 37, the first sheet sensor 11 or the like. In the meantime, the control device 10 may be configured to resume the driving of the second motor 210 at the time that the front end of the sheet S is detected by the first sheet sensor 11, for example, not after the fourth time T4 elapses.

The control device 10 is configured to control the connection/separation mechanism 300 at timing making it to the image formation on the other surface of the sheet S to switch the connection/separation mechanism 300 from the separation state shown in FIG. 2C to the first contact state shown in FIG. 2A for the color mode or from the separation state shown in FIG. 2C to the second contact state shown in FIG. 2B for the monochrome mode. Specifically, the control device 10 is configured to switch the connection/separation clutch 339 from the cutoff state to the connection state to transmit the driving force of the first motor 110 being rotating in the forward direction to the connection/separation cam 310 and to thus move rearwards the connection/separation cam 310, thereby switching the state from the separation state to the first contact state or second contact state.

<Processing By Control Device>

Subsequently, processing that is executed by the control device 10 is described with reference to FIGS. 4 to 7. Here, 'surface printing' indicated at the uppermost part of FIG. 7 means the image formation on one surface of the sheet S, and 'backside printing' means the image formation on the other surface of the sheet S. In the meantime, 'surface printing,' re-conveyance' and 'backside printing' of FIG. 7 are just to indicate operations that are performed at corresponding points of time so as to easily understand the present disclosure and do not indicate exact starting or ending timings of the corresponding operations. At a state (standby state) where the color printer 1 waits for reception of a printing job, the color printer 1 is at the separation state.

Figure 4:
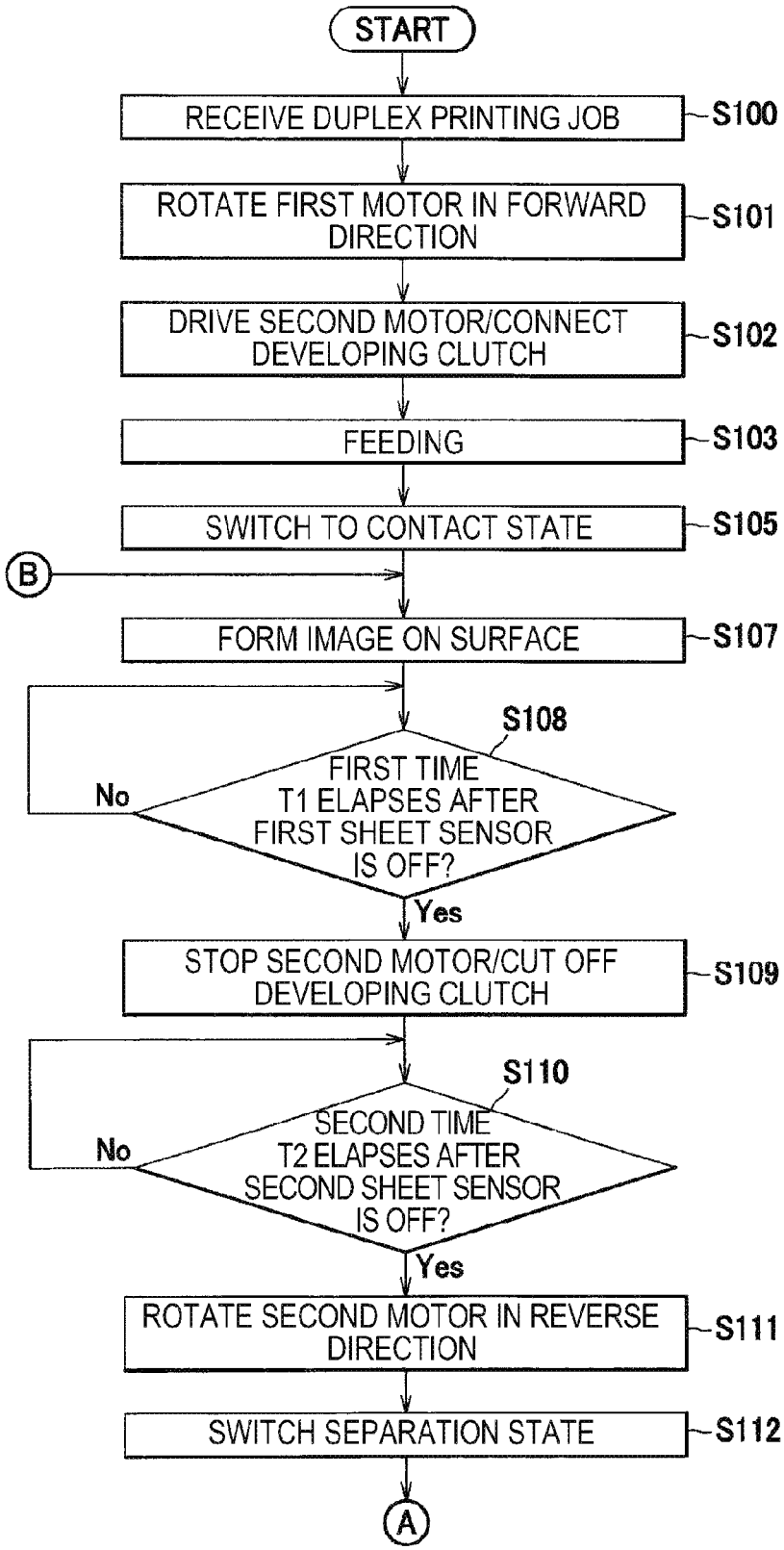
FIG. 4 is a flowchart showing processing that is executed by a control device in accordance with a first illustrative embodiment.

As shown in FIG. 4 (also refer to the timing chart of FIG. 7), when an instruction to form images on both surfaces of the sheet S or a duplex printing job including image data to be formed is received (S100, time t0), the control device 10 first rotates the first motor 110 in the forward direction (S101, time t1). The control device 10 drives the second motor 210 at timing (deviating timing) delayed than the timing at which the first motor 110 is rotated in the forward direction, and sets the developing clutch 139 to the connection state to drive the photosensitive drums 63 and developing rollers 65 (S102, time t2).

Subsequently, the control device 10 sets the feeder clutch 166 to the connection state to drive the feeder roller 33, thereby feeding the sheet S in the sheet feeding tray 31 (S103, time t3). In the meantime, after the sheet S is fed, the control device 10 switches the feeder clutch 166 to the cutoff state to stop the driving of the feeder roller 33 (time t4).

Then, the control device 10 sets the connection/separation clutch 339 to the connection state to drive the connection/separation cam 310, thereby switching the photosensitive drums 63 and the developing rollers 65 from the separation state to the contact state (for the color mode, the first contact state, and for the monochrome mode, the second contact state) (S105, time t5). In the meantime, after the contact state is made, the control device 10 switches the connection/separation clutch 339 to the cutoff state to stop the driving of the connection/separation cam 310 (time t6). After that, the control device 10 forms an image on the surface of the fed sheet S (S107, surface printing).

Then, when the first time T1 elapses after the first sheet sensor 11 becomes OFF (S108, Yes), which is timing at which the rear end of the sheet S exits between the process units 6 and the transfer unit 7, the control device 10 stops the driving of the second motor 210 and switches the developing clutch 139 to the cutoff state to stop the driving of the photosensitive drums 63 and developing rollers 65 (S109, time t9).

Subsequently, when the second time T2 elapses after the second sheet sensor 12 becomes OFF, which is timing before the rear end of the sheet S exits between the conveyance rollers 92, the control device 10 once stops the first motor 110 (time t10) and then rotates the first motor 110 in the reverse direction (S111, time t11). Thereby, the conveyance rollers 92 and the discharge rollers 93 are rotated in the reverse direction, so that the sheet S is guided to the re-conveyance path 94 and is thus re-conveyed towards the image forming unit 4.

Then, while the first motor 110 is rotated in the reverse direction, the control device 10 switches the connection/separation clutch 339 to the connection state to drive the connection/separation cam 310, thereby switching the photosensitive drums 63 and the developing rollers 65 from the contact state to the separation state (S112, time t12). In the meantime, after the separation state is made, the control device 10 switches the connection/separation clutch 339 to the cutoff state to stop the driving of the connection/separation cam 310 (time t13).

Figure 5:
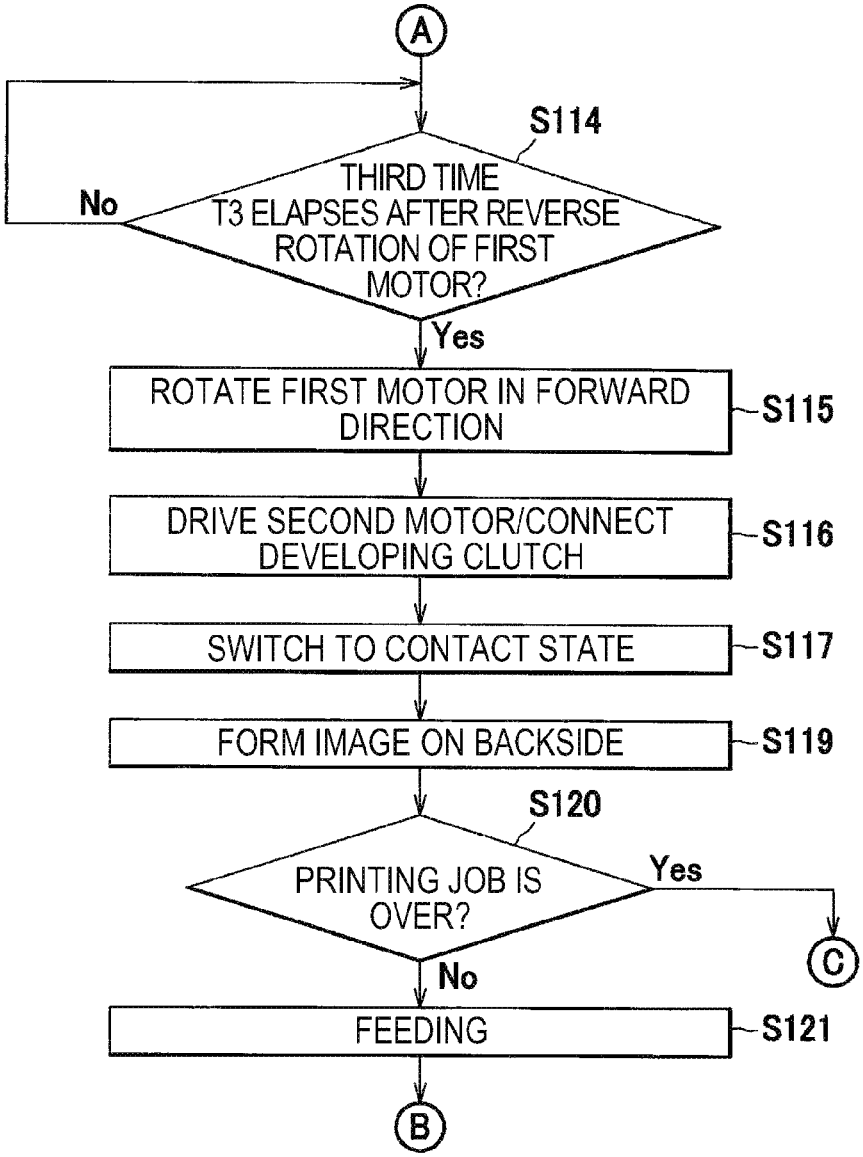
FIG. 5 is a flowchart showing processing that is executed by the control device in accordance with the first illustrative embodiment.

Subsequently, as shown in FIG. 5, when the third time T3 elapses after the reverse rotation of the first motor 110 starts (S114, Yes), the control device 10 once stops the first motor 110 (time t14) and then again rotates the first motor 110 in the forward direction (S115, time t15). Then, the control device 10 drives the second motor 210 at timing (deviating timing) delayed than the timing at which the forward rotation of the first motor 110 is resumed, and switches the developing clutch 139 to the connection state to resume the driving of the photosensitive drums 63 and developing rollers 65 (S116, time t16).

The control device 10 switches the connection/separation clutch 339 to the connection state to drive the connection/separation cam 310, thereby again switching the photosensitive drums 63 and the developing rollers 65 from the separation state to the contact state (S117, time t17). Thereafter, the control device 10 forms an image on the backside of the sheet S again fed to the image forming unit 4 (S119, backside printing). When the printing job is not over (S120, No), the control device 10 switches the feeder clutch 166 to the connection state to drive the feeder roller 33, thereby feeding a next sheet S (S121, time t21). After that, the control device 10 returns to step S107 of FIG. 4 and executes the processing and thereafter (refer to time t21 to t34).

Figure 6:
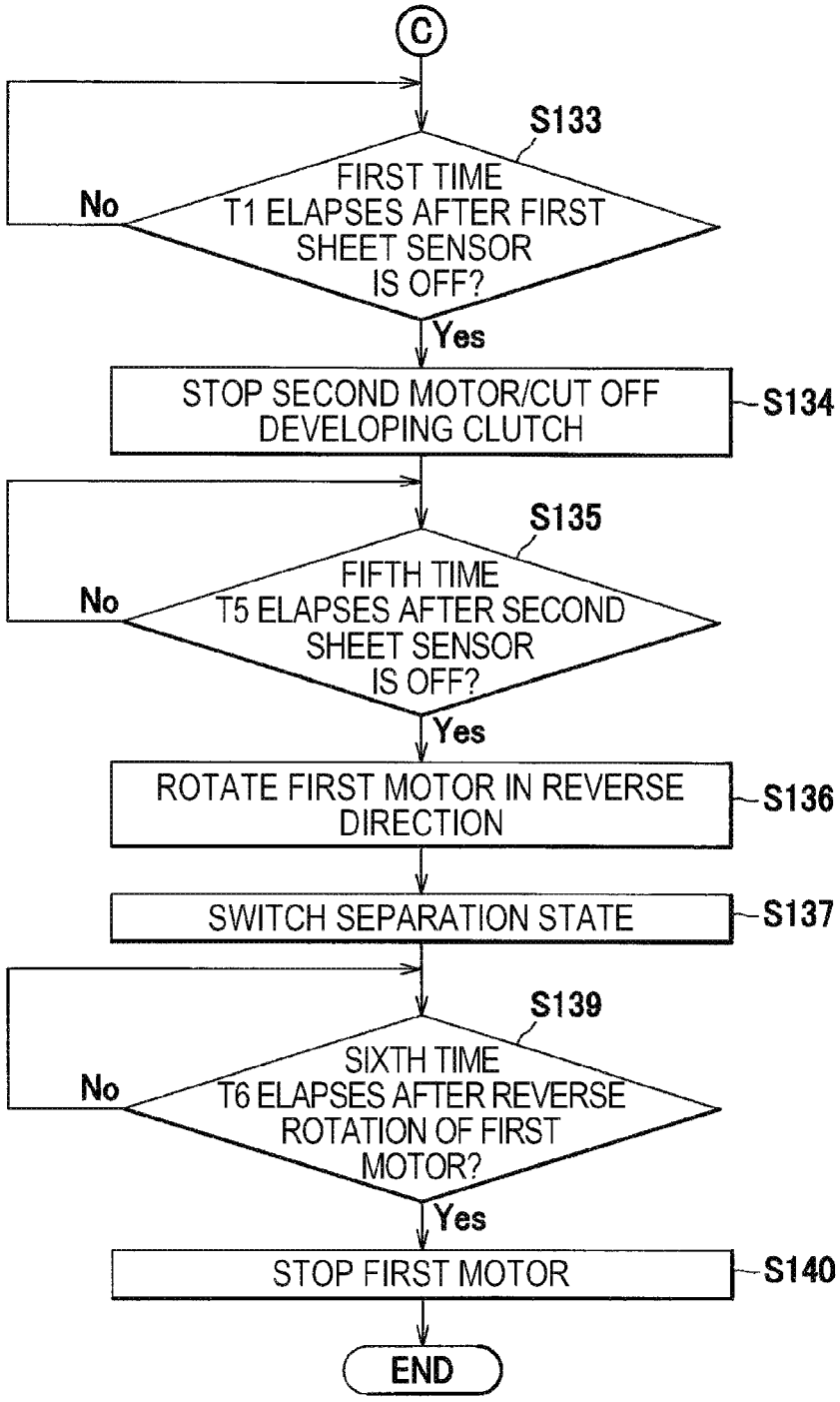
FIG. 6 is a flowchart showing processing that is executed by the control device in accordance with the first illustrative embodiment.
Figure 7:
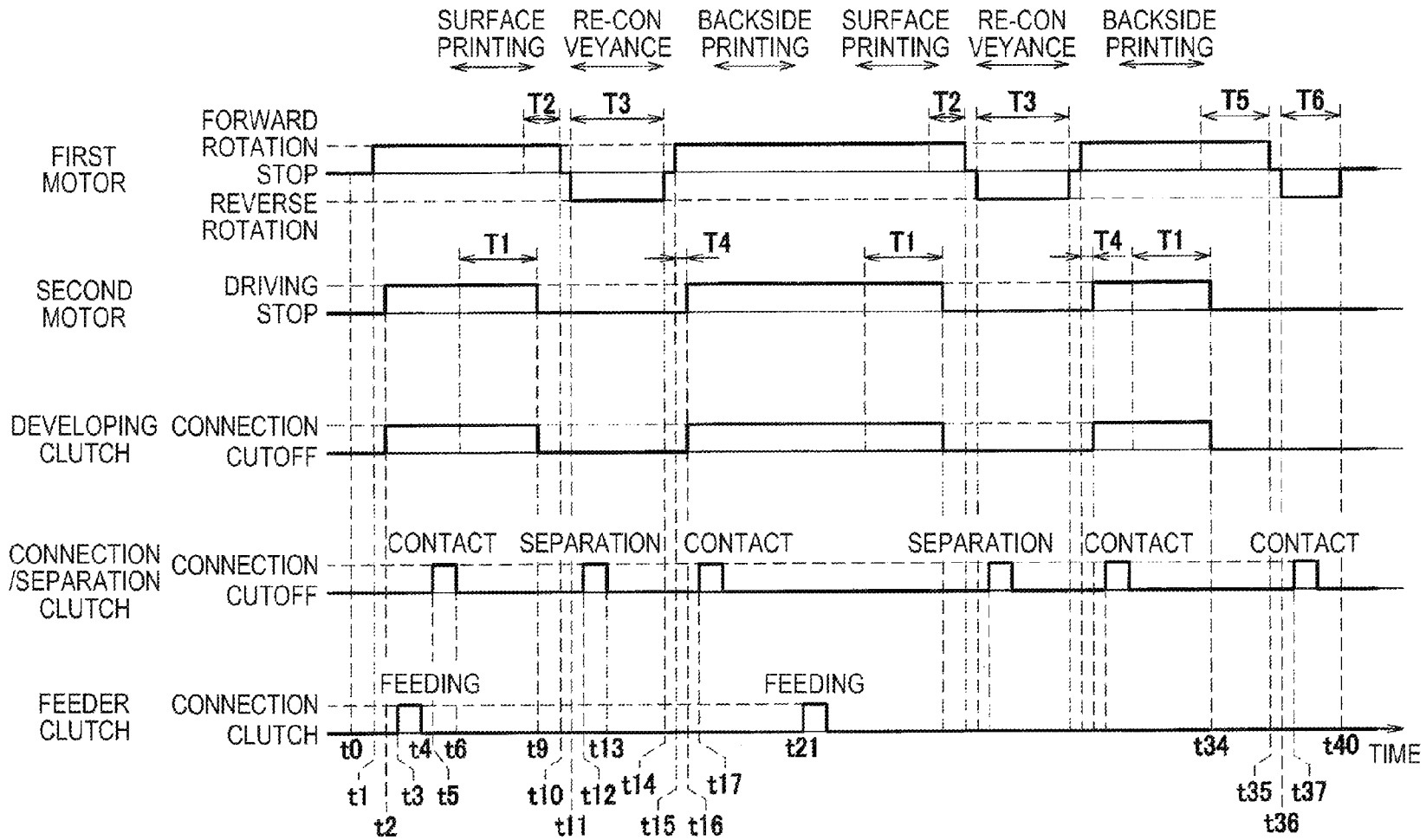
FIG. 7 is a timing chart showing driving states of a first motor, a second motor, a developing clutch, a connection/separation clutch and a feeder clutch in accordance with the first illustrative embodiment.

In step 5210 of FIG. 5, when the printing job is over (Yes), the control device 10 stops the driving of the second motor 210 and switches the developing clutch 139 to the cutoff state to stop the driving of the photosensitive drums 63 and the developing rollers 65 (S134, time t34) at the time that the first time T1 elapses after the first sheet sensor 11 becomes OFF (S133, Yes), as shown in FIG. 6.

Then, when a fifth time T5 elapses after the second sheet sensor 12 becomes OFF (S135, Yes), which is timing at which the rear end of the sheet S exits between the discharge rollers 93 and is discharged onto the sheet discharge tray 22 from the discharge opening 23, the control device 10 once stops the first motor 110 (time t35) and then rotates the first motor 110 in the reverse direction (S136, time t36).

Subsequently, while the first motor 110 is rotated in the reverse direction, the control device 10 switches the connection/separation clutch 339 to the connection state to drive the connection/separation cam 310, thereby switching the photosensitive drums 63 and the developing rollers 65 from the contact state to the separation state (S137, time t37).

Then, when a sixth time T6 elapses after the reverse rotation of the first motor 110 starts (S139, Yes), which is a time period enough to drive the connection/separation cam 310 and to thus switching the connection/separation cam 310 from the contact state to the separation state, the control device 10 stops the first motor 110 (S140, time t40) and ends the processing.

According to the above illustrative embodiment, as shown in FIG. 7, while the first motor 110 (the conveyance rollers 92 and the discharge rollers 93) is rotated in the reverse direction to re-convey the sheet S towards the image forming unit 4, the driving of the second motor 210 is stopped or the developing clutch 139 is switched to the cutoff state to stop the driving of the photosensitive drums 63 and developing rollers 65 (developing cartridges 63). In particular, after the driving of the photosensitive drums 63 and developing cartridges 62 is stopped (time t9), the discharge rollers 93 and the like are rotated in the reverse direction (time t11) or the discharge rollers 93 and the like are again rotated in the forward direction (time t15), and then the driving of the photosensitive drums 63 and developing cartridges 62 is resumed (time t16). In other words, the driving of the photosensitive drums 63 and developing cartridges 62 is stopped before the discharge rollers 93 and the like are rotated in the reverse direction, and the driving of the photosensitive drums 63 and developing cartridges 62 is resumed after the discharge rollers 93 and the like are again rotated in the forward direction. Therefore, it is possible to lengthen a time period for which the driving of the photosensitive drums 63 and developing cartridges 62 is stopped. Thereby, it is possible to suppress the unnecessary driving of the photosensitive drums 63 and developing cartridges 62. As a result, since the performances of the photosensitive drums 63, the developing cartridges 62, the toners and the like are not degraded beyond necessity, it is possible to prolong the lifetime thereof.

In this illustrative embodiment, while the discharge rollers 93 and the like are rotated in the reverse direction (while the photosensitive drums 63 and the developing cartridges 62 are stopped), the photosensitive drums 63 and the developing rollers 65 are separated from each other. Therefore, it is possible to suppress deterioration of an image quality. Making a supplementary statement, the charges of the surface of the photosensitive drum come out while the photosensitive drum is stopped. However, in a configuration where the photosensitive drum and the developing roller continue to contact each other while the photosensitive drum and the like are stopped, when the driving is resumed to start the image formation, if a region positioned between a position of the photosensitive drum facing the charger and a position of the photosensitive drum facing the developing roller during the stop is used for the image formation, the toner is not put on the region well, so that an image quality may be deteriorated. On the other hand, when the photosensitive drum 63 and the developing roller 65 are separated from each other while the photosensitive drum 63 and the like are stopped, the above region passes through the position of the photosensitive drum 63 facing the developing roller 65 at the time that the photosensitive drum 63 and the developing roller 65 are brought into contact with each other and then the image formation can be activated. Therefore, an image can be formed with the charged region of the photosensitive drum 63 facing the developing roller 65, so that the deterioration of the image quality as described above can be suppressed. In addition, the photosensitive drum and the developing roller are separated from each other while the discharge rollers and the like are rotated in the reverse direction, so that it is also possible to implement a configuration of stopping the developing roller (developing cartridge) while driving the photosensitive drum.

In the above illustrative embodiment, the developing clutch 139 is switched to the cutoff state to stop the driving of the developing cartridge 62K and the driving of the second motor 210 is stopped to stop the driving of the developing cartridges 62Y, 62M, 62C. Therefore, it is possible to suppress an increase in the cost of the color printer 1 and also to suppress the driving mechanism for transmitting the driving force to the developing cartridges 62 from being complicated and enlarged.

Making a supplementary statement, if the driving force is applied from the first motor to all the developing cartridges and the electromagnetic clutch is switched to the cutoff state to stop the driving of all the developing cartridges, the torque for driving the developing cartridges is increased. Therefore, a size of the electromagnetic clutch is increased or the number of electromagnetic clutches is increased, so that the cost may be increased. If the driving force is applied from the second motor to all the developing cartridges and the driving of the second motor is stopped to stop the driving of all the developing cartridges, a size of the second motor is increased or a cooling fan should be necessarily provided as a countermeasure against the temperature increase of the second motor, which increases the cost. In contrast, according to the above illustrative embodiment, since the above described problems are not caused, it is possible to suppress the cost increase of the color printer 1.

If the driving force is applied from one motor to all the developing cartridges, a configuration for switching the color mode in which all the developing cartridges are driven, the monochrome mode in which the driving of some developing cartridges is stopped and a mode in which the driving of all the developing cartridges is stopped may be complicated or enlarged. For example, if a swingable gear configured to switch the transmission and cutoff of the driving force between the motor and the developing cartridge is provided and the gear is enabled to swing by a cam configured to linearly move, it is necessary to provide the swingable gears between the motor and the black developing cartridge and between the motor and the developing cartridges except for the black developing cartridge, which complicates the configuration. When the two swingable gears are enabled to move by one cam, the cam is enlarged. In contrast, according to the above illustrative embodiment, since the corresponding problems are not caused, it is possible to suppress the driving mechanism from being complicated and enlarged.

In the above illustrative embodiment, the timing (time t1) at which the driving of the first motor 110 starts, the timing (time t14 to t15) at which the first motor 110 is switched from the reverse rotation to the forward rotation, and the timing (time t2, t16) at which the driving of the second motor 210 starts are made to be different each other. Therefore, it is possible to make timing, at which current is supplied to the first motor 110, and timing, at which current is supplied to the second motor 210, different. Since the high current is required to start the motor, if the timing at which the current is supplied to the first motor and the timing at which the current is supplied to the second motor are synchronized, it may be difficult to stably drive the motors upon the activations thereof. In contrast, according to the above illustrative embodiment, it is possible to stably drive the first motor 110 and the second motor 210 upon the activations thereof, respectively.

Second Illustrative Embodiment

Subsequently, a second illustrative embodiment is described. Meanwhile, in this illustrative embodiment, the differences from the first illustrative embodiment are described, and the same constitutional elements, control processing and the like as the first illustrative embodiment are denoted with the same reference numerals and the descriptions thereof are appropriately omitted.

In the first illustrative embodiment, while the discharge rollers 93 and the like are rotated in the reverse direction or while the sheet S is re-conveyed, the photosensitive drums 63 and the developing rollers 65 are separated from each other. However, in this illustrative embodiment, while the discharge rollers 93 and the like are rotated in the reverse direction or while the sheet S is re-conveyed, the photosensitive drums 63 contact the developing rollers 65, respectively. Specifically, while the conveyance rollers 92 and the discharge rollers 93 are rotated in the reverse direction, the control device 10 of this illustrative embodiment keeps the connection/separation clutch 339 at the cutoff state and does not switch the same to the connection state, so that the first contact state shown in FIG. 2A is kept in the color mode or the second contact state shown in FIG. 2B is kept in the monochrome mode.

Subsequently, the processing that is executed by the control device 10 of this illustrative embodiment is described.

Figure 8:
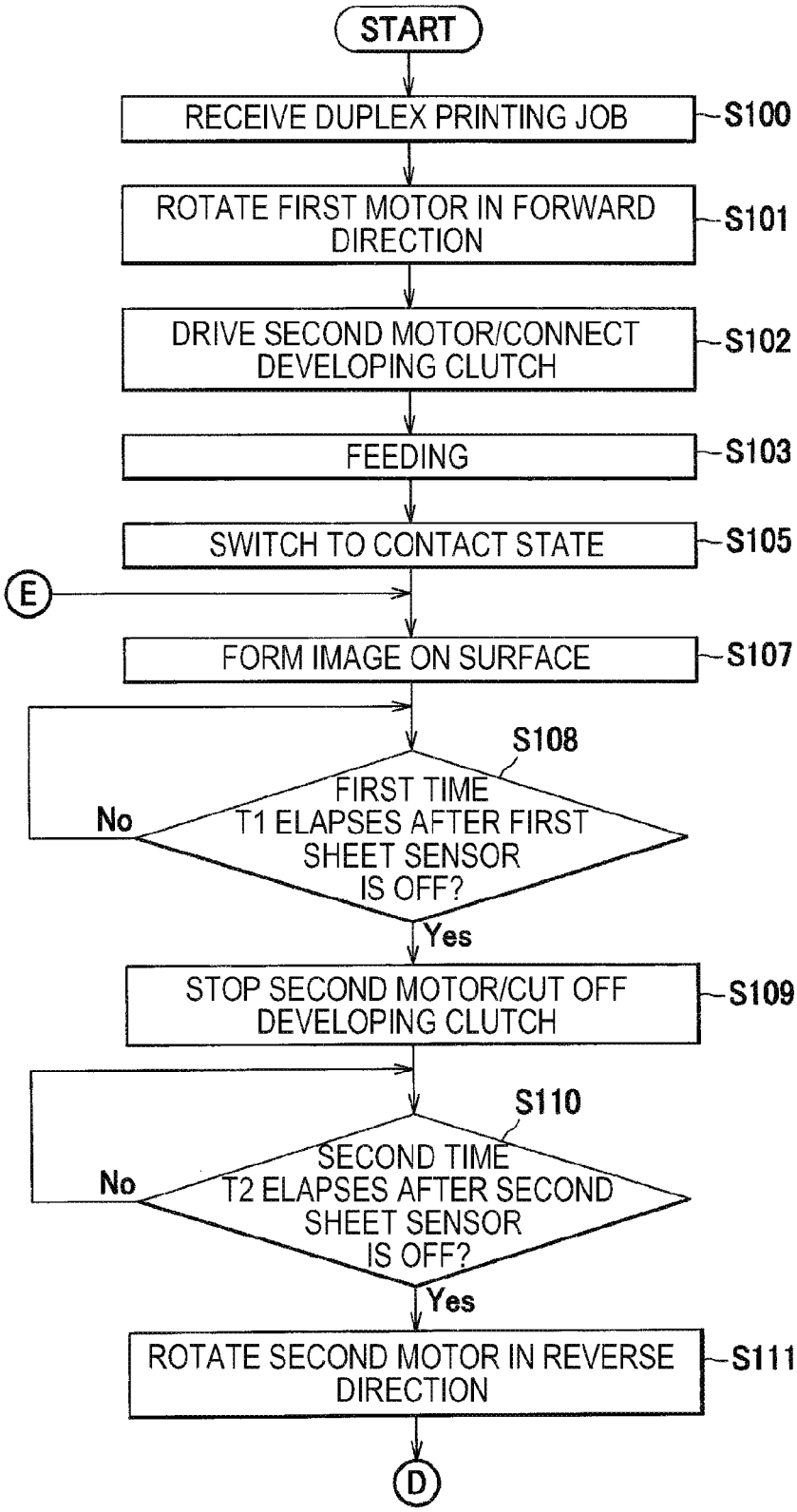
FIG. 8 is a flowchart showing processing that is executed by the control device in accordance with a second illustrative embodiment.
Figure 10:
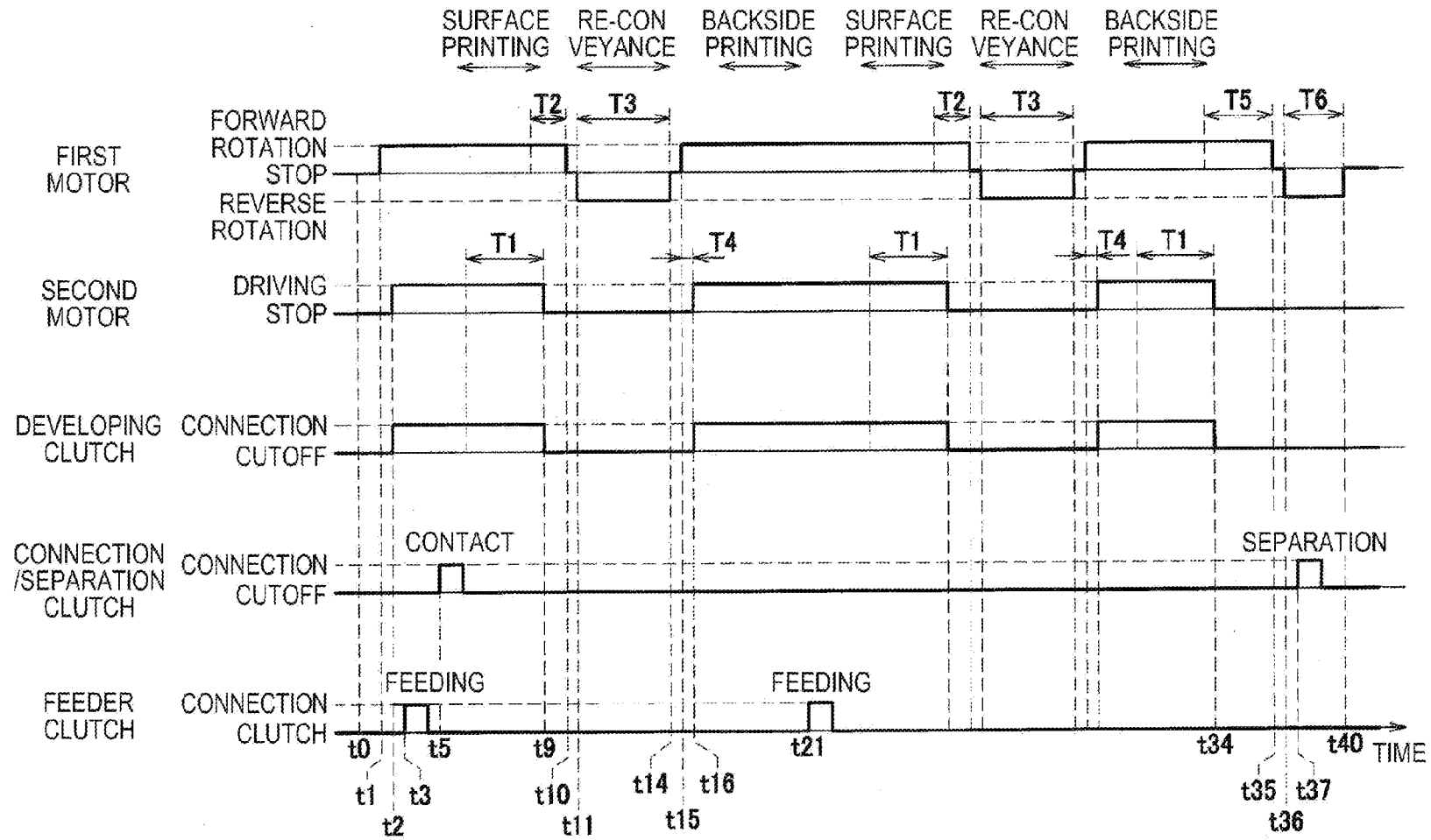
FIG. 10 is a timing chart showing driving states of the first motor, the second motor, the developing clutch, the connection/separation clutch and the feeder clutch in accordance with the second illustrative embodiment.

As shown in FIG. 8 (also refer to FIG. 10), when a duplex printing job is received (S100, time t0), the control device 10 first rotates the first motor 110 in the forward direction (S101, time t1), then drives the second motor 210 and sets the developing clutch 139 to the connection state to drive the photosensitive drums 63 and the developing rollers 65 (S102, time t2).

Then, the control device 10 feeds the sheet S from the sheet feeding tray 31 (S103, time t3). Then, the control device 10 sets the connection/separation clutch 339 to the connection state to switch the photosensitive drums 63 and the developing rollers 65 from the separation state to the contact state (for the color mode, the first contact state, and for the monochrome mode, the second contact state) (S105, time t5). Thereafter, the control device 10 forms an image on the surface of the sheet S (S107, surface printing).

Subsequently, when the first time T1 elapses after the first sheet sensor becomes OFF (S108, Yes), the control device 10 stops the driving of the second motor 210 and switches the developing clutch 139 to the cutoff state to stop the driving of the photosensitive drums 63 and the developing rollers 65 (S109, time t9). Then, when the second time T2 elapses after the second sheet sensor becomes OFF (5110, Yes), the control device 10 once stops the first motor 110 (time t10) and then rotates the first motor 110 in the reverse direction (S111, time t11) to rotate the conveyance rollers 92 and discharge rollers 93 in the reverse direction.

In the first illustrative embodiment, while the first motor 110 is rotated in the reverse direction, since the state is switched from the contact state to the separation state, the connection/separation clutch 339 is switched from the cutoff state to the connection state (refer to step S112 of FIG. 4). However, in this illustrative embodiment, the connection/separation clutch 339 is not switched and the photosensitive drums 63 and the developing rollers 65 are kept at the contact state.

Figure 9:
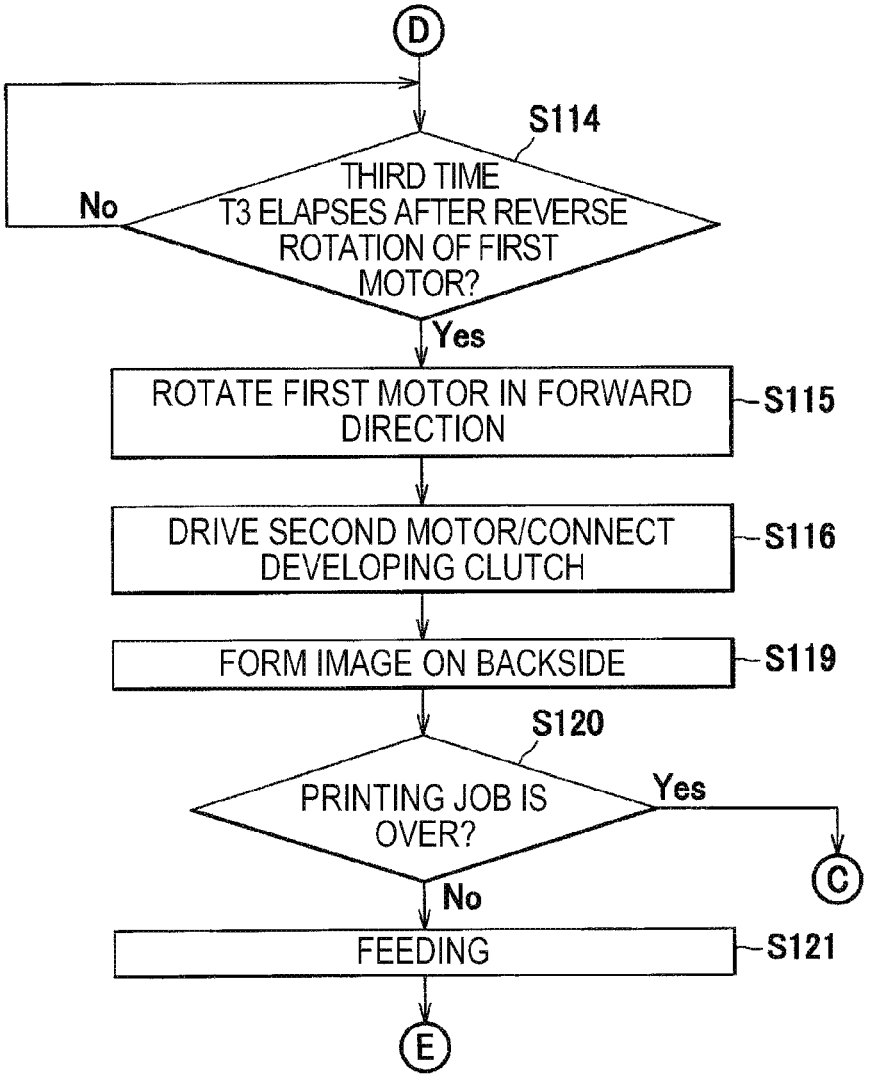
FIG. 9 is a flowchart showing processing that is executed by the control device in accordance with the second illustrative embodiment.

Then, as shown in FIG. 9, when the third time T3 elapses after the reverse rotation of the first motor (S114, Yes), the control device 10 once stops the first motor 110 (time t14) and then again rotates the first motor 110 in the forward direction (S115, time t15). Then, the control device 10 drives the second motor 210 and switches the developing clutch 139 to the connection state, thereby resuming the driving of the photosensitive drums 63 and developing rollers 65 (S116, time t16).

In the first illustrative embodiment, the connection/separation clutch 339 is switched from the cutoff state to the connection state so as to switch the state from the separation state to the contact state (refer to S117 of FIG. 5). However, in this illustrative embodiment, since the contact state is kept, the connection/separation clutch 339 is not switched.

After that, the control device 10 forms an image on the backside of the re-conveyed sheet S (S119, backside printing). When the printing job is not over (S120, No), the control device 10 feeds a next sheet S from the sheet feeding tray 31 (S121, time t21) and returns to step S107 of FIG. 8 to execute the processing and thereafter (refer to time t21 to t34). On the other hand, when the printing job is over (S120, Yes), the control device 10 executes the processing of step S133 of FIG. 6 and thereafter, like the first illustrative embodiment.

Although the illustrative embodiments have been described, the present disclosure is not limited to the above illustrative embodiments. The specific configurations can be appropriately changed without departing from the gist of the present disclosure, as follows.

In the above illustrative embodiments, the timing at which the first motor 110 is switched from the reverse rotation to the forward rotation is different from the timing at which the driving of the second motor 210 starts. However, the present disclosure is not limited thereto. For example, the timing at which the first motor 110 is switched from the reverse rotation to the forward rotation and the timing at which the driving of the second motor 210 starts may also be synchronized inasmuch as the first motor and the second motor can be stably driven upon the activations thereof In the above illustrative embodiments, the developing clutch 139 is set to the cutoff state to stop the driving of the developing cartridge 62K and the driving of the second motor 210 is stopped to stop the driving of the developing cartridges 62Y, 62M, 62C. However, the present disclosure is not limited thereto. For example, the developing clutch may not be provided, the driving force may also be transmitted from the second motor to all the developing cartridges and the driving of the second motor may be stopped to stop the driving of all the developing cartridges. The driving force may also be transmitted from the first motor to all the developing cartridges and the electromagnetic clutch may be set to the cutoff state to stop the driving of all the developing cartridges.

The configuration of the connection/separation mechanism 300 described in the above illustrative embodiments is just exemplary and is not limited to the above configuration. For example, in the above illustrative embodiments, the developing roller 65 is moved relative to the photosensitive drum 63. However, the present disclosure is not limited thereto. That is, the photosensitive drum may also be moved relative to the developing roller or both the photosensitive drum and the developing roller may be moved.

The connection/separation mechanism may not be provided (the photosensitive drum and the developing roller are not separated).

The configuration of the image forming unit 4 described in the above illustrative embodiments is just exemplary and is not limited to the above configuration. For example, in the above illustrative embodiments, the LEDs are blinked, so that the LED unit 5 exposes the surface of the photosensitive drum 63. However, the present disclosure is not limited thereto. For example, a laser scanner configured to expose the photosensitive drum with laser light may also be provided. In the above illustrative embodiments, the fixing device 8 of the roller fixing type is provided. However, the present disclosure is not limited thereto. For example, a fixing unit of a belt fixing type may also be provided. In the above illustrative embodiments, the photosensitive drum 63 has been exemplified as the photosensitive member. However, the present disclosure is not limited thereto. For example, a photosensitive belt may also be adopted. The configuration of the developing cartridge 62 described in the above illustrative embodiments is just exemplary. For example, a unit for which the developing roller and the supply roller are provided and a unit for which the toner accommodation part is provided may be detachably configured.

In the above illustrative embodiments, the two types of the rollers (the conveyance roller 92 and the discharge roller 93) are provided as the switchback roller. However, the present disclosure is not limited thereto. For example, the conveyance roller 92 may not be provided. That is, the switchback roller may be one type.

In the above illustrative embodiments, the developing clutch 139 (electromagnetic clutch) has been exemplified as the transmission switching device. However, the present disclosure is not limited thereto. For example, a mechanical clutch may also be used.

In the above illustrative embodiments, the color printer 1 having the plurality of photosensitive drums 63 (the first photosensitive member and the second photosensitive member) and the plurality of developing cartridges 62 (the first developing device and the second developing device) and capable of forming both a color image and a monochrome image has been exemplified as the image forming apparatus. However, the present disclosure is not limited thereto. For example, the image forming apparatus may be a printer having one photosensitive drum and one developing cartridge and capable of forming only a monochrome image. The image forming apparatus is not limited to the printer and may be a copier, a complex machine and the like having a document reading device such as a flat bed scanner.

In the above illustrative embodiments, the sheet S such as a normal sheet, a postcard and the like has been exemplified as the recording sheet. However, the present disclosure is not limited thereto. For example, an OHP sheet may also be used.

According to the above configuration, while re-conveying the recording sheet towards the image forming unit, the driving of the developing device can be stopped. In particular, since the switchback roller is rotated in the reverse direction after the driving of the developing device is stopped, i.e., since the driving of the developing is stopped before the switchback roller is rotated in the reverse direction, it is possible to lengthen a time period for which the driving of the developing device is stopped.

According to the above configuration, even in the configuration where a plurality of the developing devices is provided, it is possible to suppress the unnecessary driving of each developing device.

According to the above configuration, it is possible to separate the developing roller and the photosensitive member at the time that the driving of the developing device is stopped. Thereby, for example, it is possible to implement a configuration of stopping the developing roller (developing device) while driving the photosensitive member. In a configuration where the photosensitive member and the developing device are driven or stopped in conjunction with each other, it is possible to suppress deterioration of an image quality.

According to the above configuration, it is possible to suppress a cost increase of the image forming apparatus and to suppress a driving mechanism for transmitting the driving force to the developing device from being complicated and enlarged.

According to the above configuration, since it is possible to make timing, at which current is supplied to the first driving source, and timing, at which current is supplied to the second driving source, different, it is possible to stably drive the respective driving sources upon activations thereof.

According to the present disclosure, it is possible to suppress the unnecessary driving of the developing device.

What is claimed is:

1. An image forming apparatus comprising:

an image forming unit including a first photosensitive member configured to form thereon a developer image and a first developing device configured to receive developer and to supply the developer to the first photosensitive member, the image forming unit being configured to transfer the developer image onto a recording sheet and to form an image on the recording sheet;

a housing having a discharge opening configured to discharge the recording sheet having the image formed thereon, the image forming unit being disposed in the housing;

a switchback roller configured to convey the recording sheet from the image forming unit towards the discharge opening by forwardly rotating the switchback roller and to again convey the recording sheet carried out of the image forming unit towards the image forming unit by reversely rotating the switchback roller;

a first driving source including an output shaft configured to transmit a driving force, the first driving source being configured to switch a rotating direction of the output shaft and to rotate the switchback roller in one of a forward direction and a reverse direction by switching the rotating direction of the output shaft;

a control device configured to control driving of the first developing device and switchback roller; and a connection/separation mechanism configured to switch a contact state where the first photosensitive member is connected to the first developing roller and a separation state where the first photosensitive member is separated from the first developing roller.

wherein the control device stops driving of the first developing device and then rotates the switchback roller in the reverse direction when re-conveying the recording sheet towards the image forming unit, and wherein the control device is configured to control the connection/separation mechanism to set the separation state e switchback roller is rotated in the reverse direction.

2. The image forming apparatus according to claim 1, wherein the image forming unit comprises a second photosensitive member configured to form thereon a developer image and a second developing device configured to supply the developer to the second photosensitive member, the image forming apparatus comprises a second driving source configured to apply a driving force to the second developing device, and wherein the control device stops the driving of the first developing device and the second developing device and then rotates the switchback roller in the reverse direction when re-conveying the recording sheet towards the image forming unit.

3. The image forming apparatus according to claim 2, wherein the first developing device includes a first developing roller, the second developing device includes a second developing roller, the connection/separation mechanism is configured to switch the contact state where the first photosensitive member contacts the first developing roller and the second photosensitive member contacts the second developing roller and the separation state where the first photosensitive member is separated from the first developing roller and the second photosensitive member is separated from the second developing roller.

4. The image forming apparatus according to claim 2 further comprising a transmission switching device configured to switch a connection state where the driving force from the first driving source can be transmitted to the first developing device and a cutoff state where the driving force from the first driving source cannot be transmitted to the first developing device, wherein the control device is configured to set the transmission switching device to the cutoff state to stop the driving of the first developing device and is configured to stop the driving of the second driving source to stop the driving of the second developing device.

5. The image forming apparatus according to claim 4, wherein the first driving source includes a first motor, the second driving source includes a second motor, and the control device is configured to start the driving of the second driving source at timing different from timing at which the control device controls the first driving source to switch the switchback roller from the reverse rotation to the forward rotation.

6. The image forming apparatus according to claim 1 further comprising a transmission switching device configured to switch a connection state where the driving force from the first driving source can be transmitted to the first developing device and a cutoff state where the driving force from the first driving source cannot be transmitted to the first developing device, wherein the control device is configured to set the transmission switching device to the cutoff state to stop the driving of the first developing device.

7. An image forming apparatus comprising:

a rotatable first developer carrier;

a tray on which a recording sheet is to be discharged;

a switchback roller configured to rotate in a first rotating direction to convey the recording sheet in a direction coming close to the tray;

a first motor configured to apply a driving force to the first developer carrier;

a control device configured to switch a rotating direction of the switchback roller from the first rotating direction to a second rotating direction opposite to the first rotating direction after cutting off the driving force to be applied from the first motor to the first developer carrier;

a first photosensitive member; and a cam configured to move the first developer carrier between a contact position at which the first developer carrier contacts the first photosensitive member and a separation position at which the first developer carrier is separated from the first photosensitive member, wherein the control device is configured to drive the cam while the switchback roller is rotated in the second rotating direction.

8. The image forming apparatus according to claim 7 further comprising:

a clutch configured to cut off the driving force to be applied from the first motor to the first developer carrier, wherein the control device is configured to control the clutch to stop the rotation of the first developer carrier.

9. The image forming apparatus according to claim 8, wherein the first motor is configured to be rotated in a forward direction and a reverse direction and is coupled to the switchback roller to drive the switchback roller, and the control device is configured to control the first motor to reverse a rotating direction of the first motor after cutting off the driving force to be applied from the first motor to the first developer carrier.

10. The image forming apparatus according to claim 7 wherein the first motor is configured to rotate in a forward direction and a reverse direction to rotate the switchback roller, and wherein the control device is configured to reverse the first motor after cutting off the driving force to be applied from the first motor to the first developer carrier.

11. The image forming apparatus according to claim 7, wherein the control device is configured to drive the cam move the first developer carrier towards the separation position while the switchback roller is rotated in the second rotating direction.

12. The image forming apparatus according to claim 7 further comprising a rotatable second developer carrier; and a second motor configured to apply a driving force to the second developer carrier, wherein the control device is configured to switch the rotating direction of the switchback roller from the first rotating direction to the second rotating direction after cutting off the driving force to be applied from the first motor to the first developer carrier.

13. The image forming apparatus according to claim 7, wherein the first motor is coupled to the switchback roller to drive the switchback roller.

14. An image forming apparatus comprising:

a rotatable developer carrier;

a tray on which a recording sheet is to be discharged;

a photosensitive member configured to rotate and contact the developer carrier:

a switchback roller configured to rotate in a first direction and a second direction opposite to the first direction;

a first motor configured to be coupled to the developer carrier and the switchback roller and drive the developer carrier and the switchback roller;

a second motor configured to be coupled to the photosensitive member and drive the photosensitive member;

a control device, wherein the control device is configured to control the motor to reverse a rotation direction of the first motor after cutting off the driving force to be applied from the first motor to the developer carrier, wherein the second motor stops driving when the first motor rotates in a reverse direction, and wherein the second motor starts driving at a tin .1 delayed from a timing at which the first motor is switched from the reverse rotation to a forward rotation.

15. The image forming apparatus according to claim 14, further comprising a clutch configured to cut off a driving force to be applied from the first motor to the developer carrier.

16. The image forming apparatus according to claim 15, wherein the first motor is configured to be rotated in a forward direction and a reverse direction, and the control device is configured to rotate the first motor in the reverse direction after cutting off the driving force to be applied from the first motor to the developer carrier by the clutch.

17. The image forming apparatus according to claim 16, wherein the control device is configured to control the motor to drive the switchback roller to rotate in the forward direction to convey the recording sheet in a direction coming close to the tray.

* * * * *